US006390333B1

(12) United States Patent
Bozzo

(10) Patent No.: US 6,390,333 B1
(45) Date of Patent: May 21, 2002

(54) ILLUMINATING PISTOL-TYPE DEVICE FOR A PLUNGER ACTUATED AEROSOL CAN

(76) Inventor: Daniel Bozzo, 5533 St Rt 7, Kinsman, OH (US) 44428

( * ) Notice: Subject to any disclaimer, the term of this patent is extended or adjusted under 35 U.S.C. 154(b) by 0 days.

(21) Appl. No.: 09/898,069

(22) Filed: Jul. 5, 2001

(51) Int. Cl.[7] ..... B67D 5/00

(52) U.S. Cl. ..... 222/113; 222/402.15; 222/474; 222/323; 239/375; 362/96; 362/109

(58) Field of Search ..... 222/113, 402.15, 222/323, 473, 474; 239/375; 362/96, 109

(56) References Cited

U.S. PATENT DOCUMENTS 3,659,791 A * 5/1972 Clark ..... 239/375
3,776,429 A * 12/1973 DeLucia ..... 222/113
4,098,436 A * 7/1978 Kohlbeck ..... 222/474
4,186,851 A * 2/1980 Cantor ..... 222/113
4,223,804 A * 9/1980 Morris et al. ..... 222/113
4,301,946 A * 11/1981 Goldin et al. ..... 222/113
4,401,240 A * 8/1983 Brack ..... 222/323
4,434,914 A * 3/1984 Meshberg ..... 222/113
4,805,812 A * 2/1989 Brody ..... 222/402.15
4,971,257 A * 11/1990 Birge ..... 239/375
5,373,427 A * 12/1994 McLean ..... 362/96
5,901,723 A * 5/1999 Ames ..... 362/96
6,052,051 A * 4/2000 Whalen ..... 222/113

* cited by examiner

*Primary Examiner*—J. Casimer Jacyna
(74) *Attorney, Agent, or Firm*—Jacobson Holman, PLLC

(57) ABSTRACT

A pistol-type device for a plunger actuated aerosol can. The device has a hand-gripping portion with a hollow battery storage area and a pair of dual mounted holes. To power the device a power supply is mounted in the storage area. A plunger actuating lever extends through the hand gripping portion to contact the plunger of the aerosol can and actuate the plunger for spraying an area. The barrel of the pistol-type device extends from the hand-gripping portion and is in electrical communication with the power supply. The barrel holds the illuminating parts such as a light bulb and a lens for producing a light beam to illuminate the area. A can-engaging clip has a locking mechanism for locking the clip around the aerosol can and positioning the plunger actuating lever in direct contact with the plunger of the can. An extension member securely connects the barrel to the clip for solidifying the aerosol can and the pistol-type device as a single unit.

12 Claims, 1 Drawing Sheet

ILLUMINATING PISTOL-TYPE DEVICE FOR A PLUNGER ACTUATED AEROSOL CAN

BACKGROUND OF THE INVENTION

1. Field of the Invention

The present invention relates to an illuminating light for attaching to an aerosol can. More specifically, the present invention relates to a pistol shaped handle having an illuminating light for actuating an aerosol can and lighting the area to be sprayed.

2. The Prior Art

A number of patents have attempted to place handles or handle actuating devices on aerosol spray cans. For example, U.S. Pat. No. 3,112,849 to Wallace shows a handle which connects to the top of the aerosol and provides a trigger to open and close the aerosol. U.S. Pat. No. 4,432,474 to Hutchinson et al discloses a handle which directly connects to the top of the can and upon moving of the trigger opens and closes the can.

Other patents have disclosed illuminating means to light areas when the area will receive a liquid dispensed from a container. Examples of such illuminating means are found in U.S. Pat. No. 1,285,553 to Bateman and U.S. Pat. No. 3,035,738 to Bloom.

In U.S. Pat. No. 4,579,258 to Brown and U.S. Pat. No. 4,805,812 to Brody, handle actuating devices having locking means fitted to an aerosol can are described. The Brown et al patent includes a shell portion for receiving the aerosol container. The Brody patent utilizes what appears to be a frictional fit to the top of the aerosol can.

Additionally, U.S. Pat. No. 5,904,273 to Aspacher et al discloses an L-shaped body having a trigger which receives the aerosol can. U.S. Pat. No. 4,971,257 to Birge and U.S. Pat. No. 5,373,427 to Mclean discuss handles with batteries and D.C. voltage members for attachment to aerosol cans. The Birge patent does not appear to disclose an illuminating means. The Mclean patent has a switch which receives a light for illuminating an area. In this particular patent, the aerosol can slides into a container and attaches thereto.

While a number of patents show illuminating means on containers and some show handles on aerosol cans, none of the patents disclose a combination of an illuminating means fixed in the handle of an actuating device or an actuating device connecting or affixing specifically to the top of an aerosol can.

SUMMARY OF THE INVENTION

In view of the problems and disadvantages of the prior art, the present invention seeks to provide a pistol-type device for actuating an aerosol can and providing an illuminating barrel with a light bulb and a lens for producing a light beam to illuminate an area to be sprayed. More specifically, the device has a hand-gripping portion with a power supply is mounted in a storage area. A plunger actuating lever extends through the hand gripping portion to contact a plunger of the aerosol can and actuate the plunger for spraying the area. At the same time, or there about, the illuminating barrel can be switched on to illuminate the spraying area.

In order to fit snugly over the aerosol can, the pistol-type device of the present invention has a can-engaging clip with a locking mechanism for locking the clip around the aerosol can. Once locked on the can the plunger actuating lever is in direct contact with the plunger of the can. An extension member securely connects the barrel to the clip for solidifying the aerosol can and the pistol-type device as a single unit.

Accordingly, it is an object of the invention to provide a pistol-type device for a plunger actuated aerosol can and the like with a hand-gripping portion having a hollow battery storage area and a pair of dual mounted holes.

It is another object of the invention to provide a power supply mounted in the battery storage area for providing power to the pistol-type device in accordance with the preceding object which also includes a plunger actuating lever extending through the hand gripping portion to contact the plunger of the aerosol can and actuate the plunger for spraying an area.

It is a further object of the present invention to provide the pistol-type device with a pair of trunnions extending from the plunger actuating lever and pivotally engaging in the pair of dual mounted holes of the hand-gripping portion with an illuminating barrel extending from the hand-gripping portion and in electrical communication with the power supply.

Yet another object of the present invention is to provide the illuminating barrel with a light bulb and a lens for producing a light beam to illuminate the area to be sprayed.

A still further object of the present invention is to provide the pistol-type device with an extension member for securely connecting the illuminating barrel to the can-engaging clip for solidifying the aerosol can and the pistol-type device as a single unit. The extension member includes a shroud for acting as a shield to protect the hand-gripping portion from excessive spray.

Yet another object of the present invention is to provide the pistol-type device with a switch. The switch is connected to the power supply and the light bulb and controls the power to the light bulb. Also, the switch can be a push button or a toggle switch.

A still further object of the invention is to provide an illuminating pistol-type device in accordance with the preceding objects an which will conform to conventional forms of manufacture, be of simple construction and easy to use so a s to provide a device that will be economically feasible, long lasting and relatively trouble free in operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A preferred structural system embodiment and preferred subcomponents of this invention are disclosed in the accompanying drawings in which.

DESCRIPTION OF THE INVENTION

Figure 1:
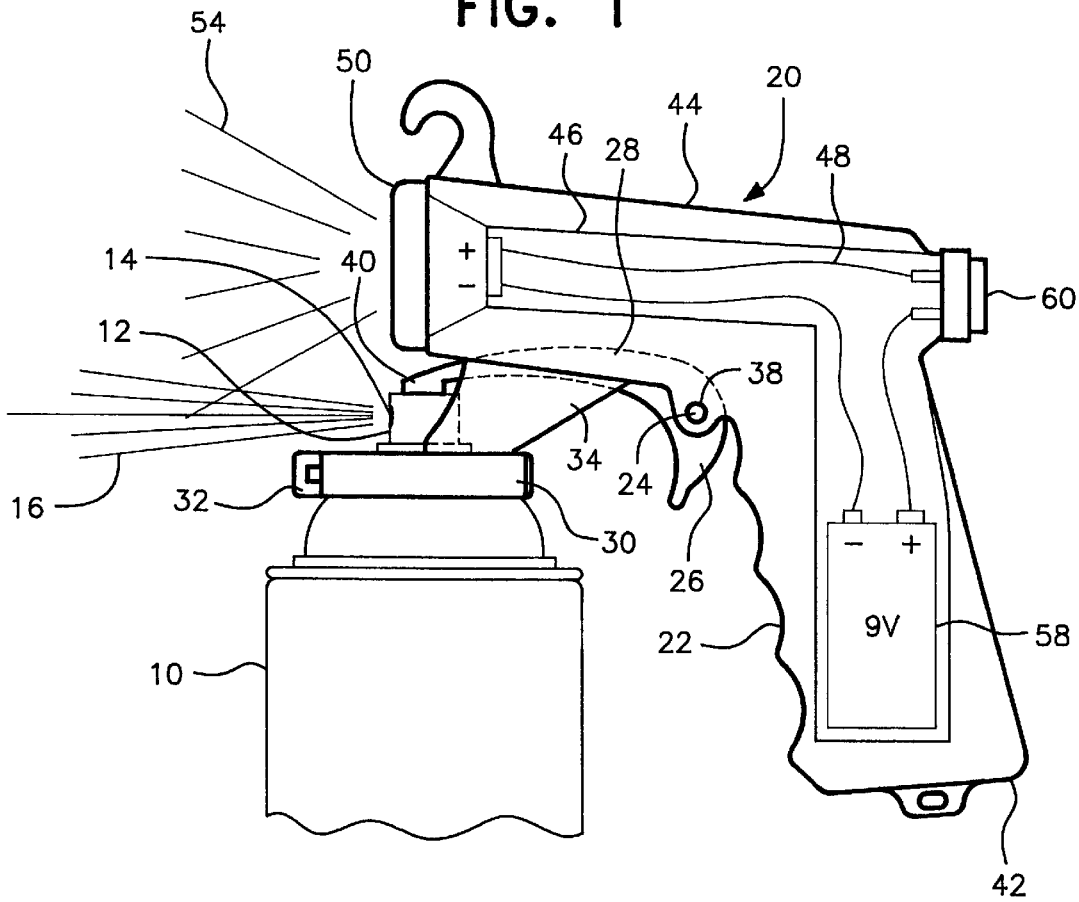
FIG. 1 illustrates the preferred embodiment of the invention showing a pistol-type handle attached to a top of an aerosol can with an illuminating element as set forth in the present invention.

Although only one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Referring to the drawings, numeral 10 designates a conventional spray can of the well-known type adapted to dispense such liquids as lubricants, paints, bug repellant or the like, the aerosol being forced from the can 10 by gas pressure through a plunger 12 which, when depressed, opens a control valve in the can, (not shown). Aerosol cans, like can 10, are becoming more and more uniform on the top for safety and ease of use reasons.

Each can has a spray orifice 14, in the plunger 12, through which the spray emerges. While such a spray can 10 does not form a part of the invention, it serves to illustrate one of the uses to which the present invention may be adapted.

A pistol-type device is generally denoted by the numeral 20 and comprises a hand gripping portion 22 which also pivotally sockets trunnions 24 of a trigger 26 with a plunger actuating lever 28, and a can-engaging portion or clip 30. The pair of trunnions 24 extend perpendicular from the plunger actuating device 28.

The can-engaging clip 30 is an adjustable plastic clip with a locking member 32 whose inner periphery is partially defined circumferentially by the top of the can 10 when the can-engaging clip 32 is wrapped around the top end of the can 10.

An extension 34 connects the pistol-type device 20 to the can-engaging clip 30 and acts to solidify the aerosol can 10 and the pistol-type device 20 as one unit. The extension 34 has a shield or a shroud 36 to protect the user from the spray 16.

Figure 2:
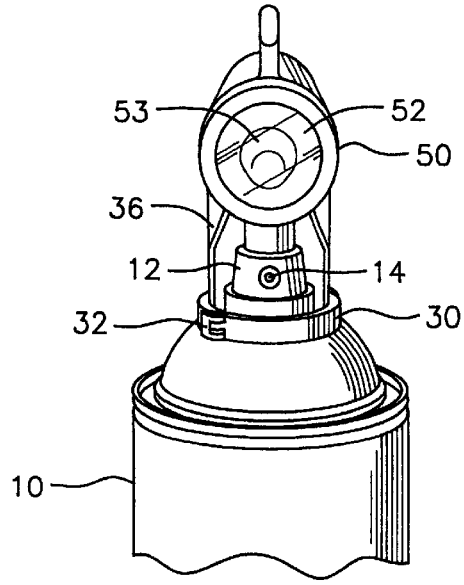
FIG. 2 illustrates a front perspective view of the illuminating element attached to the aerosol can as set forth in the present invention.

As best shown in the frontal perspective view of FIG. 2, the extension portion 34 has an opening therethrough to pass the plunging actuating lever 28, and at the opposite sides of the latter opening the extension 28 has registering holes 38 to pivotally receive the trunnions 24 of the lever 28. The lever 28 has a finger engageable part 40 which directly contacts the plunger 12 of the aerosol can 10.

Referring to FIG. 1, the pistol-type device 20 has a main frame or housing 42 in the shape of a gun. This housing is preferably made from molded material as plastic or some of the numerous rubber or rubber-substitute compounds. Preferably it is not metallic to the end that the weight may be kept to a minimum and then by having it nonconductive the electrical connections and switching are greatly simplified. While there are many ways in which the housing 42 could be formed, it is preferred that it be a unitary molding for both strength and cheapness and provision is made for the adequate assembly and servicing of the device. It has a hollow battery storage area for electrical connections and storage of a power source.

An upper portion 44 of the housing 42 is barrel shaped and generally represented by numeral 46. The illuminating barrel 46 provides a proper housing for a pair of wires 48 and a 9 volt illuminating light 50.

As shown in FIG. 2, light 50 is preferably of the type having a lens portion 52 and a bulb 53 in the extreme end of the light 50 so as to produce a relatively wide beam of light 54. It is preferred to have the wide beam to completely light the area being sprayed.

In the hand gripping portion 22 is a battery 58 connected to the pair of wires 48 and an on/off switch 60. The switch 60 can be any type of switch. It is preferred that a push button type switch be used. A toggle switch has also been contemplated. From the on/off switch 60, there is connected the 9-volt illuminating light 50. As discussed, the light 50 once switched on will illuminate a wide area. The area is where ever the barrel 46 of the pistol-type device 20 is pointing. The trigger 26 actuates the spray orifice 14 of the can 10 for spraying, preferably at a time when the light is on.

As an added feature, a hook 60 is attached on the upper portion 44 near the light 50. The hook 60 permits the device 20 to be hung while in operation so that the light beam 54 illuminates the area before spraying. Also, there is contemplated a tab 62 and hole 64 therein affixed to the handle 22 for hanging or storing the device 20 during nonuse.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A pistol-type device for a plunger actuated aerosol can, said device comprising:

a hand-gripping portion having a hollow battery storage area and a pair of dual mounted holes;

a power supply mounted in said battery storage area for providing power to said pistol-type device;

a plunger actuating lever extending through said hand gripping portion to contact the plunger of the aerosol can and actuate the plunger for spraying an area;

a pair of trunnions extending from said plunger actuating lever and pivotally engaging in said pair of dual mounted holes of said hand-gripping portion;

an illuminating barrel extending from said hand-gripping portion and in electrical communication with said power supply, said illuminating barrel having a light bulb and a lens for producing a light beam to illuminate the area;

a can-engaging clip having a locking mechanism for locking said clip around the aerosol can for position said plunger actuating lever in direct contact with the plunger of the can; and an extension member for securely connecting said illuminating barrel to said can-engaging clip for solidifying the aerosol can and said pistol-type device as a single unit.

2. The pistol-type device for the plunger actuated aerosol can as recited in claim 1, wherein said pair of trunnions extend perpendicular from said plunger actuating device.

3. The pistol-type device for the plunger actuated aerosol can as recited in claim 1, wherein the power supply is at least one battery.

4. The pistol-type device for the plunger actuated aerosol can as recited in claim 3, wherein the battery is at least nine volts.

5. The pistol-type device for the plunger actuated aerosol can as recited in claim 1, wherein said extension member includes a shroud for acting as a shield to protect the hand-gripping portion from excessive spray.

6. The pistol-type device for the plunger actuated aerosol can as recited in claim 1, comprising:

a switch connected to said power supply and said light bulb for controlling said power to said light bulb.

7. The pistol-type device for the plunger actuated aerosol can as recited in claim 6, wherein said switch is a push button switch.

8. The pistol-type device for the plunger actuated aerosol can as recited in claim 6, wherein said switch is a toggle switch.

9. The pistol-type device for the plunger actuated aerosol can as recited in claim 1, comprising:

a hook extending from said illuminating barrel for hanging said pistol-type device during use of said pistol-type device.

10. The pistol-type device for the plunger actuated aerosol can as recited in claim 1, wherein said pistol-type device is made from molded plastic material.

11. The pistol-type device for the plunger actuated aerosol can as recited in claim 1, wherein said pistol-type device is made from a rubber or rubber-substitute compounds.

12. The pistol-type device for the plunger actuated aerosol can as recited in claim 1, wherein said pistol-type device is a unitary molding.

* * * * *